United States Patent [19]

Estebanell

[11] 4,011,631

[45] Mar. 15, 1977

[54] COMBING-CLEANING DEVICE FOR UNIVERSAL CARDS

[76] Inventor: Juan Barcons Estebanell, Avd. Doctor Fleming San Fructuoso de Bages, Barcelona, Spain

[22] Filed: Dec. 9, 1975

[21] Appl. No.: 639,017

[30] Foreign Application Priority Data

Mar. 26, 1975 Spain ..... 211105

[52] U.S. Cl. ..... 19/100; 19/104

[51] Int. Cl.[2] ..... D01G 15/04

[58] Field of Search ..... 19/99, 100, 101, 113, 19/98, 104

[56] References Cited

UNITED STATES PATENTS

| | | | |
|---|---|---|---|
| 2,243,685 | 5/1941 | Schiessler | 19/100 |

FOREIGN PATENTS OR APPLICATIONS

| | | | |
|---|---|---|---|
| 750,191 | 5/1933 | France | 19/113 |
| 106,151 | 10/1899 | Germany | 19/99 |
| 53,826 | 8/1967 | Poland | 19/100 |
| 15,493 | 1911 | United Kingdom | 19/101 |
| 591,813 | 8/1947 | United Kingdom | 19/100 |

*Primary Examiner*—Dorsey Newton

*Attorney, Agent, or Firm*—Blum, Moscovitz, Friedman & Kaplan

[57] ABSTRACT

At least one assembly grouping of cooperating cylindrical rollers comprising a rotatable worker and a rotatable stripper roller is mounted in specific relation to a rotatable carding drum. The worker roller performs a pick-up and retaining function in that it picks up the fibrous web from the carding drum, retains the fibrous web thereon and delivers it onto the stripper roller whereon the web is combed, cleaned and discharged onto the carding drum. This operation may be repeated a plural number of times until the web is discharged from the carding drum. The worker and stripper rollers are rotatably journalled in the carding drum housing, both rollers being rotatable in a first direction, while the carding drum is rotatable in a second direction. The carding drum and rollers have a planetary arrangement. In the arrangement of the rollers relative to the carding drum, the worker roller is mounted upstream relative to the stripper roller. The gauge distances among the drum and rollers is constant. Formed in the respective surfaces of the carding drum and rollers, are respective surfaces of the carding drum and rollers, are respective pluralities of angularly oriented teeth arranged to carry the web around the respective surfaces thereof. These pluralities of teeth in the drum and rollers are formed in their respective directions of rotation relative to each other.

7 Claims, 3 Drawing Figures

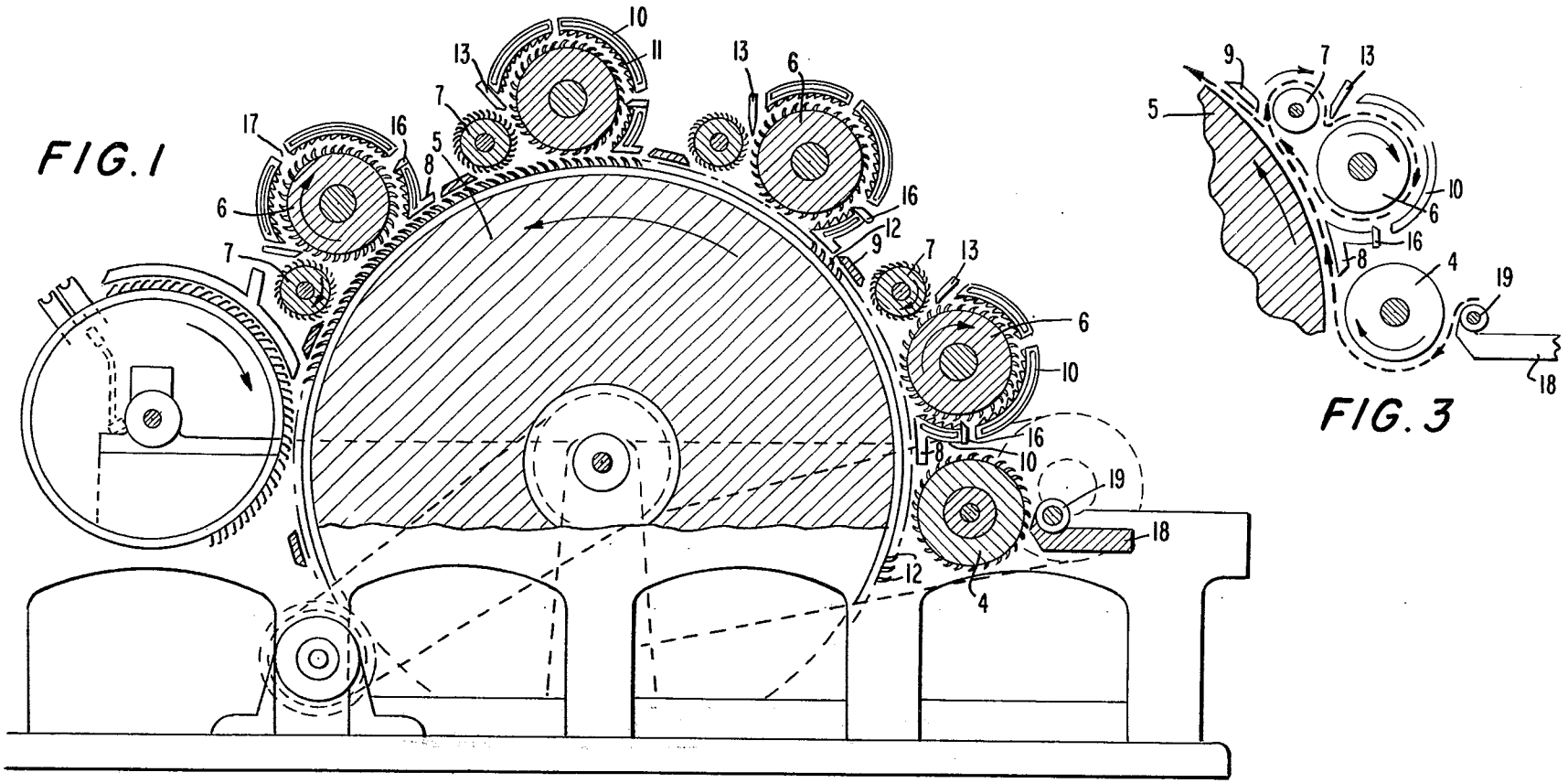
FIG. 1
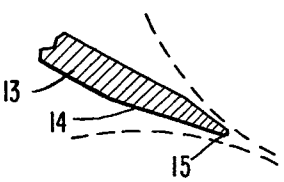
FIG. 2
FIG. 3

COMBING-CLEANING DEVICE FOR UNIVERSAL CARDS

BACKGROUND OF THE INVENTION

This invention relates to an improved carding device and more particularly, to a comber-cleaner assembly which cooperates with the carding device.

The comber-cleaner assembly of the instant invention is suited for combing and cleaning all of the conventional natural and synthetic fibers. The assembly has an auxiliary mounting correlative to a conventional carding device and is found to increase the efficiency and yield of the carded fiber. The instant assembly maximizes the surface area of the carding drum to optimally purify the processed fibers.

Incoming fibers are continuously in process through their transit on the carding drum. The assembly comprises a plurality of subassemblies proximately mounted around the carding drum. Each of the subassemblies is synchronous with the carding drum.

SUMMARY OF THE INVENTION

Generally speaking, in accordance with the invention, at least one assembly grouping of cooperating cylindrical rollers comprising a rotatable worker and a rotatable stripper roller is mounted in specific relation to a rotatable carding drum. The worker roller performs a pick-up and retaining function in that it picks up the fibrous web from the carding drum, retains the fibrous web thereon and delivers it onto the stripper roller whereon the web is combed, cleaned and discharged onto the carding drum. This operation may be repeated a plural number of times until the web is discharged from the carding drum. The worker and stripper rollers are rotatably journalled in the carding drum housing, both rollers being rotatable in a first direction, while the carding drum is rotatable in a second direction. The carding drum and rollers have a planetary arrangement. In the arrangement of the rollers relative to the carding drum, the worker roller is mounted upstream relative to the stripper roller. The gauge distances among the drum and rollers is constant. Formed in the respective surfaces of the carding drum and rollers, are respective pluralities of angularly oriented teeth arranged to carry the web around the respective surfaces thereof. These pluralities of teeth in the drum and rollers are formed in their respective directions of rotation relative to each other.

The stripper roller has a larger diameter than the lead roller, and a plurality of plaque segments substantially surround the stripper roller. Provided on the interior surface of these plaque segments are pluralities of teeth oriented oppositely to the rotational direction of the stripper roller and oppositely in direction as compared with the teeth provided in the surface of the stripper roller. Confronting the carding drum is an extension of one of the plaque segments for a purpose hereinafter described in detail.

In practice, a feed roller delivers the fibrous web onto the carding drum. As the web is carried on the drum, it is taken up by the worker roller and delivered onto the stripper roller as the web passes under a doctor blade. The web is subjected to a vigorous cleaning and combing action as it is carried past the plaque segments surrounding the stripper roller and the combed and cleaned web is redelivered onto the carding drum where it substantially bypasses the worker roller. A plurality of discrete worker and stripper roller assemblies may be, and preferably are, located around the surface of the carding drum.

Accordingly, it is an object of the invention to provide an improved carding device.

A further object of the invention is to provide a comber and cleaner assembly that may be used to process and reprocess fibers a plural number of times between the fiber feed roll for the carding drum and the discharge point for fibers from the drum.

Still other objects and advantages of the invention will in part be obvious and will in part be apparent from the specification.

The invention accordingly comprises the features of construction, combinations of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which:

FIG. 1 is a sectional view of the improved carding device constructed in accordance with the instant invention;

FIG. 2 is a detailed view of the doctor blade under which the fibrous web passes as it is transferred from the cylindrical worker roller to the cylindrical stripper roller in the comber-cleaner assembly; and FIG. 3 is a schematic representation of a comber-cleaner assembly constructed in accordance with the instant invention, showing the system of operation thereof.

DETAILED DESCRIPTION OF THE INVENTION

Referring now to FIG. 1, the planetary arrangement of a plurality of comber-cleaner assemblies around the carding drum 5 may be seen. Each comber-cleaner assembly includes a worker roller 7 and a stripper roller 6 and the number of such assemblies which cooperate with carding drum 5 is variable and depends upon the diameter of carding drum 5. The gauge distances between worker roller 7 and stripper roller 6 in each comber-cleaner assembly is substantially constant and the gauge distances between worker roller 7 and stripper roller 6 in each comber-cleaner assembly relative to carding drum 5 is substantially constant. As may be seen in the FIG. 1, carding drum 5 is rotatably journalled in a pair of supports mounted on a base member. A belt drive is provided for the purpose of rotating carding drum 5. Each comber-cleaner assembly mounted around the perimeter of carding drum 5 is rotatably journalled in support bearings provided in the carding drum housing and the assemblies are rotatably driven by a means not shown.

Relative to the counter-clockwise rotation of carding drum 5 and the relative arrangement of the comber-cleaner assemblies around the perimeter thereof, a plurality of gauge plates 8 having a contour corresponding to the curvature of carding drum 5 are mounted adjacent the drum. Relative to the direction in which the fibrous web is carried on carding drum 5, each of the gauge plates 8 is arranged adjacent the drum to immediately precede each comber-cleaner assembly in the rotational direction of drum 5. Each of the gauge plates 8 overlie carding drum 5. A second plurality of corresponding gauge plates 9 also having a contour corresponding to the curvature of carding drum 5 are mounted adjacent the drum and each of the gauge plates 9 is located immediately after a comber-cleaner assembly in the rotational direction of drum 5. Each of these gauge plates 9 overlie and face drum 5. Each pair of gauge plates 8 and 9 delimit the field of action of a corresponding comber-cleaner assembly.

Carding drum 5 is provided with a plurality of teeth 12 which are angularly oriented toward the rotational direction of drum 5 for releasably maintaining the fibrous web in process on the drum surface during transit thereof. Worker roller 7 and stripper roller 6 are rotated oppositely in a direction relative to carding drum 5, however, rollers 6 and 7 are rotated in the same direction. Therefore, as seen in the Figure, rollers 6 and 7 are rotated clockwise. Each roller 7 is provided with a plurality of teeth for picking up fibrous webbing from carding drum 5 and each plurality of these teeth is angularly oriented oppositely to the rotational direction of roller 7. Each of the stripper rollers 6 is similarly provided with a plurality of teeth for carrying the fibrous webbing delivered thereto by worker roller 7. However, the plurality of teeth carried on stripper roller 6 is angularly oriented in the rotational direction of roller 6.

Each of the stripper rollers 6 is partially surrounded by three plaque segments 10. Located on the interior surface of plaque segments 10 are pluralities of teeth 11 having a general orientation opposite to the angular orientation of the teeth provided in stripper roller 6.

Worker roller 7 is placed a predetermined distance from stripper roller 6 and a doctor blade 13 is mounted therebetween in a point of delivery of the fibrous web from worker roller 7 onto stripper roller 6. Referring particularly to FIG. 2, a fragmentary detailed view of doctor blade 13 may be seen. Doctor blade 13 has a generally rectangular longitudinal section and an obliquely angled sharp edge 14 which terminates in a rounded vertex 15. As may be seen by reference to FIG. 3, doctor blade 13 is mounted between rollers 6 and 7 in such a way that the fibrous web transferred from worker roller 7 to stripper roller 6 passes under the sharpened edge 14 of doctor blade 13 and the rounded tip 15 of doctor blade 13 has a relative orientation toward stripper roller 6. As the fibrous web passes under doctor blade 13, its path is deformed by doctor blade 13.

Referring again to FIG. 1, with respect to plaque segments 10, it may be observed that each of the segments is separated by a channel 17. In the first such slot 17, a sharp knife or extractor blade 16 is mounted having a blade which is considerably sharper than the edge provided on doctor blade 13. The blade edge of knife 16 projects into the channel formed between roller 6 and plaque segments 10 wherein the fibrous web is carried. As the fibrous web is carried past knife 16 it is scraped for the purpose of removing impurities carried on the web.

The operation of the assembly may be seen with reference to FIG. 3. In practice, a web of fiber is introduced onto the carding drum from a table 18 by a feed roller 19 which cooperates with a takerin roller 4. Takerin roller 4 is rotatably journalled in the drum housing and is rotated in the same direction as rollers 6 and 7. Pluralities of teeth provided in takerin roller 4 carry the fibrous web onto carding drum 5. On carding drum 5 the fibrous web passes under gauge plate 8 and is maintained on the drum until taken up by worker roller 7, and carried thereon under doctor blade 13 which deforms the web and inverts the fibers therein until the web is delivered onto stripper roller 6. As the fibrous web is carried on follower roller 6, it is subjected to a combing and cleaning action against the teeth in plaque segments 10 and a final scraping action by blade 16. The combing and scraping action to which the web is subjected as it is carried on roller 6 orients the web and the web is redelivered onto drum 5. Scrapings from the web caused by blade 16 are pneumatically collected by a means not shown. The oriented web which is redelivered onto drum 5 passes under gauge plate 9 and out of the field of action of the comber-cleaner assembly, and as the web is carried on drum 5 it is introduced into the field of action of a second such assembly. The combing and cleaning action preferably occurs a plural number of times and is performed by a plurality of such assemblies mounted around the perimeter of drum 5, as seen in FIG. 1.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A comber-cleaner assembly for a carding device of the type including a rotatable carding drum having a first direction of rotation and provided with means for carrying a fibrous web on the surface thereof, a feed roller for taking up the fibrous web from a table and a takerin roller cooperating therewith to deliver the fibrous web on the drum surface, said comber-cleaner assembly comprising at least one assembly grouping of cooperating cylindrical rollers, including a rotatable worker roller and a rotatable stripper roller mounted in specific relation to the carding drum, the worker and stripper rollers being rotatable in the same direction which corresponds to a second direction relative to the rotational direction of the carding drum, the worker roller being mounted upstream of the stripper roller relative to the direction of rotation of the carding drum, a plurality of plaque segments partially surrounding the stripper roller, the worker roller including means for picking up the fibrous web from the carding drum and carrying the fibrous web on the surface thereof for delivery to the stripper roller, the stripper roller including means for carrying the delivered web on the surface thereof, the plaque segments including means on the interior surface thereof which cooperate with the stripper roller for cleaning and combing the fibrous web as it is carried on the surface of the stripper roller, the stripper roller having a path of rotation for redelivering the cleaned and combed fibrous web onto the carding drum and extractor blade means positioned between a pair of plaque segments for removing impurities from the web.

2. The comber-cleaner assembly as claimed in claim 1 including a doctor blade located between the worker roller and stripper roller, the doctor blade being located at a point in the passage of the fibrous web from the worker roller onto the stripper roller, the fibrous web being passed under the doctor blade as it is transferred onto the stripper roller and the fibrous web being deformed thereby during its transfer from the worker roller to the stripper roller.

3. The comber-cleaner assembly as claimed in claim 2, the doctor blade having a generally rectangular longitudinal section, an obliquely angled sharp edge, and a rounded vertex, the obliquely angled sharp edge terminating in the rounded vertex, the doctor blade being arranged so as to permit the sharp edge to engage the fibrous web as it is transferred from the worker roller to the stripper roller.

4. The comber-cleaner assembly as claimed in claim 1, each of the plaque segments in the plurality thereof being separated by a channel, and said extractor blade means being mounted in one of the channels and being in the form of a knife, the knife having a blade end, the blade end of the knife extending towards the stripper roller so as to scrape the fibrous web as it is carried past the knife on the stripper roller.

5. The comber-cleaner assembly as claimed in claim 4 wherein said knife is mounted on one of said plaque segments.

6. The comber-cleaner assembly as claimed in claim 1 including at least one gauge plate overlying the carding drum contiguous with and located upstream of the stripper roller relative to the rotational direction of the carding drum.

7. The comber-cleaner assembly as claimed in claim 1 including a gauge plate overlying the carding drum contiguous with and located downstream of the worker roller relative to the rotational direction of the carding drum.

* * * * *